United States Patent [19]

Eatherly

[11] Patent Number: 4,928,851

[45] Date of Patent: May 29, 1990

[54] TUBE CONTENTS EXPULSION SLEEVE

[76] Inventor: Pauline C. Eatherly, 12528 Kenobi Ct., Cerritos, Calif. 90701

[21] Appl. No.: 300,169

[22] Filed: Jan. 23, 1989

Related U.S. Application Data

[63] Continuation of Ser. No. 115,817, Nov. 2, 1987, abandoned.

[51] Int. Cl.[5] ..... B65D 35/28

[52] U.S. Cl. ..... 222/103; 222/95

[58] Field of Search ..... 222/95, 103, 214; 251/9–10

[56] References Cited

U.S. PATENT DOCUMENTS

| | | | |
|---|---|---|---|
| 2,083,603 | 6/1937 | Harwick | 222/95 |
| 3,248,012 | 4/1966 | Adams | 222/95 |
| 3,313,455 | 4/1967 | Kemmer | 222/103 |
| 4,159,787 | 7/1979 | Wright | 222/103 |
| 4,502,613 | 3/1985 | Yamamoto | 222/103 |
| 4,579,254 | 4/1986 | Puskarcik | 222/95 |

FOREIGN PATENT DOCUMENTS

| | | | |
|---|---|---|---|
| 515130 | 8/1955 | Canada | 222/103 |
| 1009136 | 5/1952 | France | 222/103 |

*Primary Examiner*—Michael S. Huppert

*Attorney, Agent, or Firm*—Boniard I. Brown

[57] ABSTRACT

A sleeve for efficiently emptying the contents of a flexible tube filled with viscous material. The sleeve is generally arrowhead shaped having manual gripping structures on the opposite sides thereof and facing internal lands which engage the exterior surfaces of the tube. When slid toward the nozzle of the tube, the sleeve forces the contents of the tube out the open nozzle. The manual gripping structures can be depressed grip regions which correspond to the internal lands, serrations, and/or upstanding finger engaging abutment surfaces. In some embodiments the edges holding the opposite sides together are flexible so that pressure thereon tends to spread the internal lands and pressure on the grips tends to move the internal lands closer together.

11 Claims, 2 Drawing Sheets

TUBE CONTENTS EXPULSION SLEEVE

This is a continuation of co-pending application Ser. No. 115,817 filed on Nov. 2, 1987, now abandoned.

BACKGROUND OF THE INVENTION

Tubes, such as those used to hold toothpaste, caulking material, silicon sealant and the like, for either domestic or industrial use, are preferred containers when a relatively small amount of viscous material needs to be stored conveniently for instant use. Originally, such containers were made from ductile metal and the materials therein were forced out by rolling the tubes up from their filling end to their nozzle end. With the advent of suitable flexible plastic materials, metal tubes have almost entirely disappeared from the marketplace. This has occurred because plastic tubes have less tendency to rip and tear, are generally more economical to manufacture and are relatively inert to various materials stored therein which heretofore would attack metal containers.

The convenience and economy of such tubes is lost if they are emptied in a careless manner so that much of the contained material becomes trapped in wrinkles in the tube. Therefore, a variety of devices have been designed which attempt to assure easy complete emptying of such tubes. Some devices, such as are shown in U.S. Pat. No. 4,448,333 to FERRARI and U.S. Pat. No. 4,579,254 to PUSKARCIK, are rachet-type devices which squeeze the tube and gradually move thereup. Such devices are not always desirable as they tend to leave residual pressure in the tube which can cause unwanted flow, either before the tube cap can be reapplied or upon next opening. Others, such as shown in U.S. Pat. No. 2,390,314 to MASSEY and U.S. Pat. No. 2,790,579 to WOLDORF nibble up the tube and are more adapted for the old style metal tubes than modern resilient plastic tubes. Some are slider devices adapted to be merely pushed up the tube, such as shown in U.S. Pat. No. 2,554,975 to BENDICK and U.S. Pat. No. 4,159,787 to WRIGHT. WRIGHT discloses a more sophisticated device having a forwardly facing extension to push material out of the tube when the tube is nearly empty and streamlined internal surfaces so that the tube slides easily through the device. WRIGHT and others, such as ADAMS, U.S. Pat. No. 3,248,012 also include a releasable clip for those instances where it is difficult to get a sleeve device over the end of the tube in the first place. However, with all these devices there is still room for improvement.

BRIEF DESCRIPTION OF THE PRESENT INVENTION

The present sleeve in its multiple embodiments is preferably a unitary structure having two or more facing internal lands for contact with the sides of a tube to force material out through the nozzle thereof. The lands preferably have an arrowhead-shape with the point of the arrow facing toward the nozzle when the sleeve is installed on a tube. It is preferable this shape also be continued in the body of the sleeve since this shape is efficient in removing the last small amount of material when the tube is almost empty. The embodiments shown have generally planar upper and lower sides on whose exteriors arrowhead depressions, serrations, and/or abutment surfaces shaped to engage human fingers are formed. These structures ease the application of manual force to the sides so the sleeve can be easily installed and slid along the length of a tube during operation. In some embodiments the edges connecting the upper and lower sides are made from thin, relatively flexible plastic material. Manual force applied to the edges thereof expands the opening between the internal lands for easy installation on a tube, and compressive force on the sides allows the internal lands to press firmly across the width of the tube.

It is therefore an object of the present invention to provide an improved sleeve device for use in forcing the contents of a container tube out its nozzle.

Another object is to provide an expulsion sleeve which is shaped to assure complete emptying of a tube on which it is used.

Another object is to provide an expulsion sleeve having mechanical depressions, serrations or abutment surfaces on the outer surfaces of its sides to allow easy manual manipulation thereof.

Another object is to provide a tube contents expulsion sleeve which is relatively economical to manufacture and can be used over and over with various tubes.

Another object is to provide a sleeve which can be constructed in various sizes for use on tubes of different sizes.

These and other objects and advantages of the present invention will become apparent to those skilled in the art after considering the following detailed Specification together with the accompanying drawings wherein:

DETAILED DESCRIPTION OF THE SHOWN EMBODIMENTS

Figure 1:
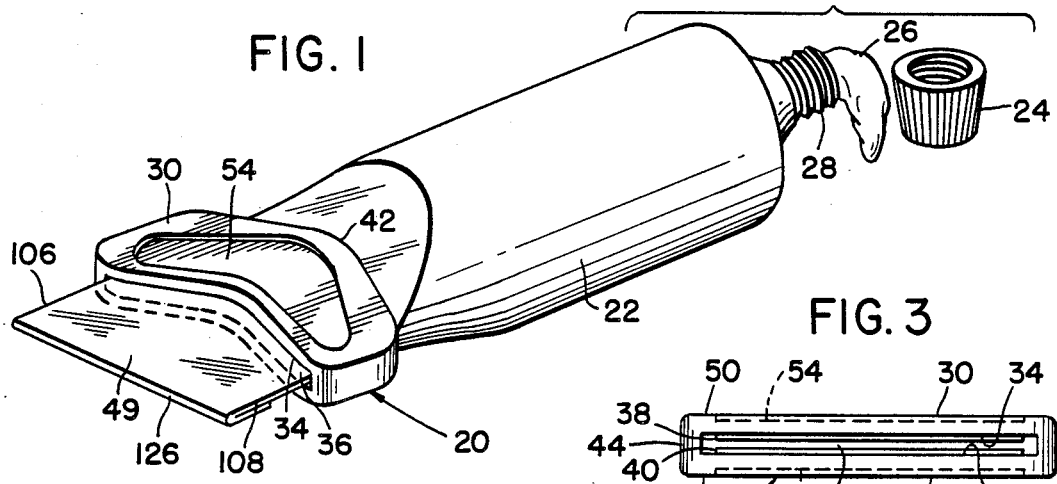
FIG. 1 is perspective view of a sleeve constructed according to the present invention installed on and being used to expel the contents of an open tube.
Figure 3:
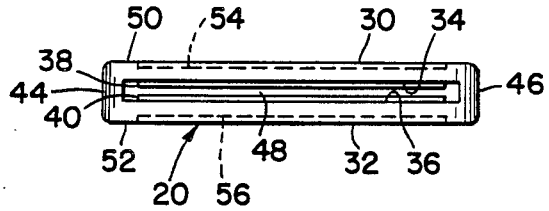
FIG. 3 is a rear elevational view of the sleeve of FIGS. 1 and 2.
Figure 2:
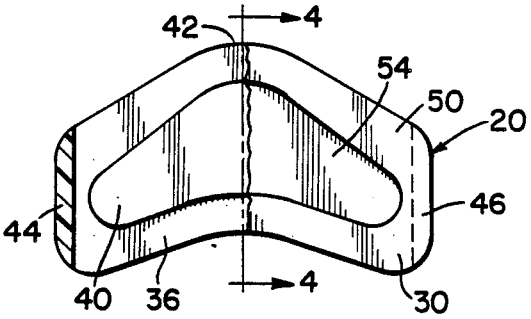
FIG. 2 is a partial cutaway top plan view of the sleeve of FIG. 1.
Figure 4:
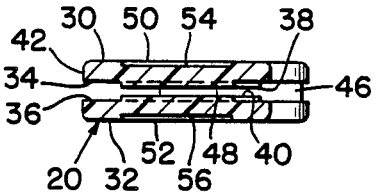
FIG. 4 is a cross-sectional view taken on line 4—4 of FIG. 2.

Referring to the drawings more particularly by reference numbers, number 20 in FIG. 1 refers to an expulsion sleeve constructed according to the present invention in position on a tube 22 whose cap 24 has been removed. The sleeve 20 is being used to force material 26 stored within the tube 22 out its nozzle 28. As shown in FIGS. 2, 3 and 4, the sleeve 20 is a unitary device having upper and lower sides 30 and 32 whose interior surfaces 34 and 36 include arrowhead-shaped lands 38 and 40. The arrowhead-shaped of the lands 38 and 40 is generally duplicated by the shape of the upper and lower sides 30 and 32 so that a nose 42 is formed which can be used to force the maximum amount of material 26 out of the tube 22 when the sleeve 20 is adjacent the nozzle 28.

The sleeve 20 preferably is constructed from plastic or other economical and nonrusting material. However, metal can be used. The upper and lower sides 30 and 32 are retained together by edges 44 and 46 which maintain a small slot 48 between the lands 38 and 40 to allow passage of the compressed portion 49 of the tube 22.

Figure 5:
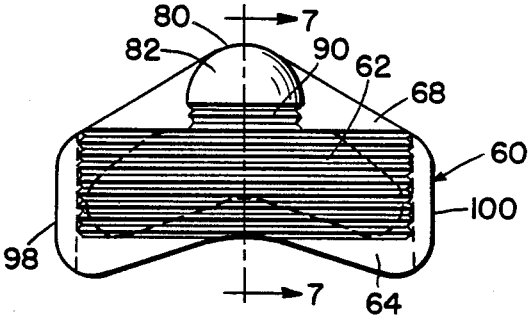
FIG. 5 is a top plan view of a modified embodiment of the present invention.
Figure 6:
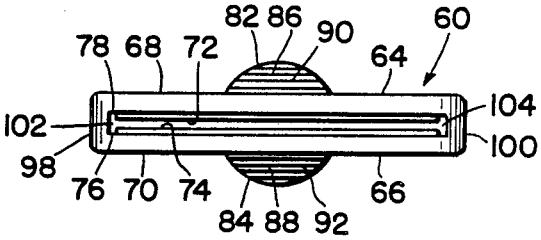
FIG. 6 is rear elevational view of the sleeve of FIG. 5.
Figure 7:
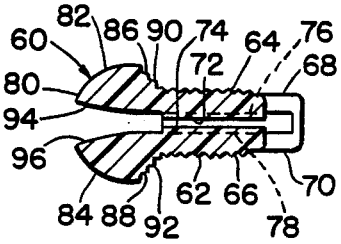
FIG. 7 is a cross-sectional view taken on line 7—7 of FIG. 5.
Figure 8:
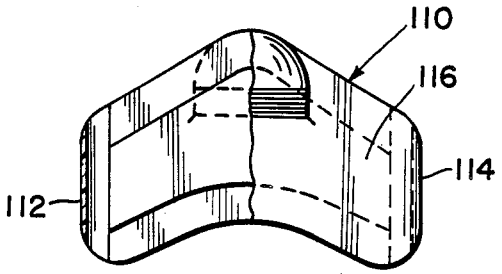
FIG. 8 is a partially cutaway top plan view of another embodiment of the present invention similar to the sleeve of FIG. 5.
Figure 9:
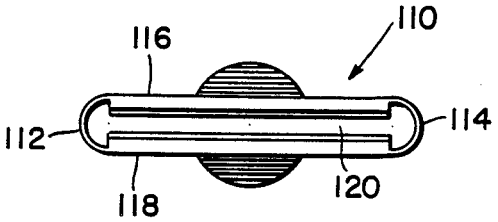
FIG. 9 is a rear elevational view of the sleeve of FIG. 8 at rest.

The outer surfaces 50 and 52 of the upper and lower sides 30 and 32 include arrowhead-shaped grip enhancement depressions 54 and 56 which generally follow the outline of the lands 38 and 40. As is shown in FIG. 5 and 6 with modified sleeve 60, grip enhancement may also be obtained by molding serrations 62 into the upper and lower surfaces 64 and 66 of the upper and lower sides 68 and 70 thereof. The sleeve 60 is similar to sleeve 20 having arrowhead-shaped lands 72 and 74 on the upper and lower interior surfaces 76 and 78 thereof. The lands 72 and 74 are assisted in expelling the material 26 from the tube 22 by forming the nose 80 of the sleeve 60 in the shape of two bulbous formations 82 and 84 whose back sides 86 and 88 form serrated, upstanding abutment surfaces 90 and 92 which are shaped and positioned to engage the fingers when the sleeve 60 is being forced up the tube 22, thereby allowing the application of additional force. To reduce friction and thereby decrease the force required to move the sleeve 60 along the tube 22, the leading edges 94 and 96 of the interior surfaces 76 and 78 are flared outwardly so that the tube 22 is smoothly guided therebetween. It should also be noticed in FIG. 6 that the lands 72 and 74 do not necessarily extend to the edges 98 and 100 of the sleeve 60. This allows small spaces 102 and 104 to be formed to allow the edges 106 and 108 of the tube 22 some relief when the tube 22 is constructed of relatively thick material which does not bend easily through 180°.

Figure 10:
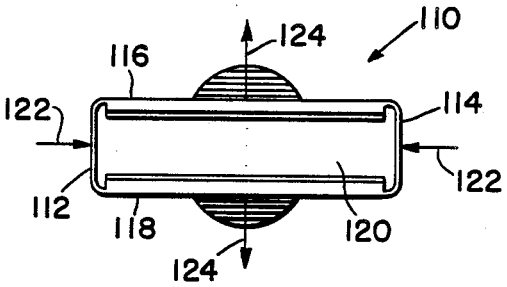
FIG. 10 is a rear elevational view similar to FIG. 9 of the sleeve of FIG. 8 when expanded by having force applied from edge-to-edge thereof.
Figure 11:
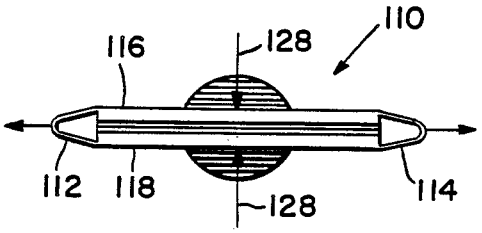
FIG. 11 is a rear elevational view similar to FIG. 9 of the sleeve of FIG. 8 with compressive force being applied to the upper and lower surfaces thereof.

FIGS. 8, 9, 10 and 11 show a modified sleeve 110 similar to sleeve 60 but having flexible edges 112 and 114 of a generally semicircular cross section instead of the relatively rigid straight edges 98 and 100. This allows the sleeve 110 to be molded so that when it is at rest its upper and lower sides 116 and 118 can have a relatively large gap 120 therebetween. As shown in FIG. 10, pressure in the direction of the arrows 122, causes the sides 116 and 118 to move in the direction of arrows 124 so that the gap 120 is increased. This is desirable when the sleeve 110 is to be installed on a tube 22 with a relatively thick closed end 126. As shown in FIG. 11, force in the direction of arrows 128 can eliminate the gap 120 between the sides 116 and 118 when a tube 22 is not installed therebetween and this force is therefore more readily applied when the tube 22 is between the sides 116 and 118.

Figure 12:
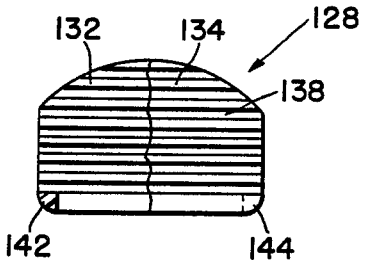
FIG. 12 is a partially cutaway top plan view of another embodiment of the present invention.
Figure 13:
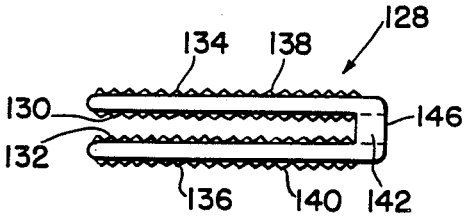
FIG. 13 is an enlarged side elevational view of the sleeve of FIG. 12.

In FIGS. 12 and 13 another modified sleeve 128 is shown having interior lands 130 and 132 which are serrated as are the outer surfaces 134 and 136 of its upper and lower sides 138 and 140. Its edges 142 and 144 which retain the sides 138 and 140 together are only formed adjacent the back 146 of the sleeve 128 so that the sides 138 and 140 are flexibly retained thereby and can be forced together about a tube 22 to expel its contents as the sleeve 128 is slid therealong.

Thus there has been shown and described novel sleeves for expelling the contents of flexible tubes which fulfill all of the objects and advantages sought therefore. Many changes, modifications, variations, uses and other applications of the subject invention will however become apparent to those skilled in the art after considering this Specification and the accompanying drawings. All such changes, modifications, variations and other uses and applications which do not depart from the spirit and scope of the invention are deemed to be covered by the invention which is limited only to the claims which follow.

What is claimed is:

1. A sleeve for use with a container tube for movement in a direction longitudinal of the tube to assist in removing contents from the tube, the sleeve including:
   - first and second arrowhead shaped sides, each of said sides having a leading edge having a centrally located nose;
   - an outer surface with manual grip enhancement means thereon;
   - the sleeve being deformable by manual pressure on the grip enhancement means to assist in expressing contents from the tube;
   - an inner surface having at least one upstanding land thereon, said land having a central portion extending at least a substantial portion of the length of the sleeve longitudinal of the tube, the outer portions of the land extending a substantially less distance than the central portion; and
   - first and second opposite edges connecting said first and second sides together in a closely spaced relationship.

2. The sleeve as defined in claim 1 wherein said first and second opposite edges are relatively small flexible edge portions located adjacent said trailing edges so that said noses of said first and second sides can be flexed together.

3. The sleeve as defined in claim 2 wherein said lands include a plurality of serrations extending across said inner surfaces.

4. The sleeve as defined in claim 1 wherein said first and second opposite edges are relatively thin and flexible.

5. The sleeve as defined in claim 4 wherein said first and second opposite edges are semicircular in cross section when in an unstressed condition.

6. A sleeve according to claim 1, wherein:
   - the trailing edge of the sleeve is curvilinear and concave to accommodate manual gripping and handling in installation and operation of the sleeve.

7. A sleeve for use with a container tube to assist in removing contents from the tube, the sleeve including:
   - first and second arrowhead shaped sides, each of said sides having:
     - a leading edge having a centrally located nose,
     - an outer surface with manual grip enhancement means thereon, and
     - an inner surface having at least one upstanding land thereon,
   - said at least one upstanding land on each inner surface being arrowhead shaped with a nose generally toward the leading edges of the first and second sides, and first and second opposite edges connecting said first and second sides together in a closely spaced relationship.

8. The sleeve as defined in claim 7 wherein said manual grip enhancement means on each outer surface are arrowhead shaped.

9. The sleeve as defined in claim 8 wherein said at least one land extends across said inner surface.

10. The sleeve as defined in claim 8 wherein said lands extend across said inner surfaces almost to said first and second edges to form small gaps therebetween.

11. The sleeve as defined in claim 7 wherein said manual grip enhancement means on each outer surface include at least one depression.

* * * * *